US009617774B2

(12) United States Patent
Broadhead et al.

(10) Patent No.: US 9,617,774 B2
(45) Date of Patent: Apr. 11, 2017

(54) COMPOSITE CHECK ARM FOR VEHICLE DOOR

(71) Applicant: WARREN INDUSTRIES LTD., Concord (CA)

(72) Inventors: Douglas Broadhead, Brampton (CA); Gareth Kenworthy, Stouffville (CA)

(73) Assignee: WARREN INDUSTRIES LTD., Concord and ON (CA)

( * ) Notice: Subject to any disclaimer, the term of this patent is extended or adjusted under 35 U.S.C. 154(b) by 0 days.

(21) Appl. No.: 14/300,979

(22) Filed: Jun. 10, 2014

(65) Prior Publication Data

US 2015/0354259 A1 Dec. 10, 2015

(51) Int. Cl.
*E05C 17/20* (2006.01)
*E05F 5/00* (2006.01)
*E05F 5/06* (2006.01)

(52) U.S. Cl.
CPC ..... *E05F 5/06* (2013.01); *E05C 17/203* (2013.01); *Y10T 16/61* (2015.01)

(58) Field of Classification Search
CPC .. E05F 5/06; E05C 17/22; E05C 17/12; E05C 17/20; E05C 17/203; E05C 17/206
USPC ..... 16/82, 85, 86 B, 86 C
See application file for complete search history.

(56) References Cited

U.S. PATENT DOCUMENTS 1,918,652 A * 7/1933 Marbach ..... 16/82
2,079,054 A 5/1937 Vadasz
2,115,811 A * 5/1938 Hansen ..... 16/86 C
2,166,970 A * 7/1939 Schonitzer ..... 16/86 C
2,677,851 A * 5/1954 Beyer ..... 16/86 R
4,751,766 A * 6/1988 Fahs et al. ..... 16/332
5,098,510 A * 3/1992 Krummenacher ..... 156/433
5,152,030 A * 10/1992 Cogo ..... E05C 17/206 16/344
5,173,991 A 12/1992 Carswell
6,349,448 B1 2/2002 Breed et al.
7,076,833 B2 * 7/2006 Murayama et al. ..... 16/82
7,240,399 B2 * 7/2007 Murayama et al. ..... 16/82
7,469,944 B2 * 12/2008 Kitayama et al. ..... 292/262
(Continued)

FOREIGN PATENT DOCUMENTS

CA 2628528 A1 10/2009
GB EP0005916 * 5/1979 ..... F16F 1/18
GB 2355489 A * 4/2001 ..... E05C 17/206

OTHER PUBLICATIONS

PCT/CA2015/000376, International Search Report, Sep. 29, 2015.

*Primary Examiner* — Emily Morgan
(74) *Attorney, Agent, or Firm* — Millman IP Inc.

(57) ABSTRACT

In an aspect, a check arm for a vehicle door is provided, and includes a body, a pivot connector and an end stop. The body has a length and defines a longitudinal axis, and has a first body end and a second body end. The pivot connector is positioned at the first body end and is configured for pivotally connecting the check arm to one of a vehicle body and a vehicle door. The end stop is positioned at the second body end, and is positioned to limit the amount of withdrawal of the check arm from a check arm keeper on the other of the vehicle body and the vehicle door. The body includes a plurality of elongate structural fibers and a binder that connects the structural fibers together. Each structural fiber extends longitudinally along substantially the length of the body.

17 Claims, 8 Drawing Sheets

(56) References Cited

U.S. PATENT DOCUMENTS

| | | | | |
|---|---|---|---|---|
| 7,908,709 | B2 | 3/2011 | Cruz et al. | |
| 9,126,367 | B1 * | 9/2015 | Mark et al. | |
| 2006/0207059 | A1 * | 9/2006 | Van Den Heuvel | 16/86 B |
| 2007/0149080 | A1 * | 6/2007 | Asahara et al. | 442/239 |
| 2011/0016665 | A1 * | 1/2011 | Ng | 16/85 |
| 2013/0031747 | A1 * | 2/2013 | Gobart et al. | 16/82 |
| 2013/0164449 | A1 * | 6/2013 | Tadepalli et al. | 427/322 |
| 2014/0291886 | A1 * | 10/2014 | Mark et al. | 264/163 |
| 2015/0247025 | A1 * | 9/2015 | Ichikawa et al. | 428/220 |
| 2015/0367808 | A1 * | 12/2015 | Aselage et al. | 280/728.3 |

* cited by examiner

COMPOSITE CHECK ARM FOR VEHICLE DOOR

FIELD

This disclosure relates generally to check arms for vehicle doors.

BACKGROUND

Vehicle doors are typically swung between fully closed and fully opened positions to permit ingress and egress of passengers to and from a vehicle. A door check assembly is typically employed to limit how far open the door can be swung. Traditional door check assemblies suffer from a number of deficiencies, however. For example, the check arm that is part of a door check assembly is typically relatively expensive and complex to manufacture. It would be beneficial to provide a check arm that is less complex and less expensive to manufacture, for use in a door check assembly for a vehicle door.

SUMMARY

In an aspect, a check arm for a vehicle door is provided, and includes a body, a pivot connector and an end stop. The body has a length and defines a longitudinal axis, and has a first body end and a second body end. The pivot connector is positioned at the first body end and is configured for pivotally connecting the check arm to one of a vehicle body and a vehicle door. The end stop is positioned at the second body end, and is positioned to limit the amount of withdrawal of the check arm from a check arm keeper on the other of the vehicle body and the vehicle door. The body includes a plurality of elongate structural fibers and a binder that connects the structural fibers together. Each structural fiber extends longitudinally along substantially the length of the body.

In a particular embodiment, each structural fiber extends from a first structural fiber end positioned proximate the second body end, along the length of the body to the pivot connector, around a distal end of the pivot connector, and along the length of the body to a second structural fiber end that is positioned proximate the second body end.

In another aspect, a vehicle door is provided, and includes a body, a pivot connector and an end stop. The body defines a longitudinal axis and has a first body end and a second body end. The pivot connector is positioned at the first body end and is configured for pivotally connecting the check arm to one of a vehicle body and a vehicle door. The end stop is positioned at the second body end, and is positioned to limit the amount of withdrawal of the check arm from a check arm keeper on the other of the vehicle body and the vehicle door. The body has a plurality of first teeth thereon which are skewed towards the first body end. Each first tooth has a first tooth face facing the first body end and a second tooth face facing the second body end. The end stop includes a blocking member and a wedge member. The blocking member is positioned to engage a limit surface to limit the amount of withdrawal of the check arm from a check arm keeper, and has a first wedge surface that faces generally towards the second body end. The wedge member has a plurality of second teeth thereon that are skewed towards the second body end. The wedge member further includes a second wedge surface that is engageable with the first wedge surface and is oriented such that a longitudinal force exerted on the blocking member towards the second body end urges the first wedge surface into the second wedge surface, which in turn urges the second teeth transversely inwardly towards the second tooth faces of the first teeth and longitudinally towards the first tooth faces of the first teeth.

Other inventive aspects of the present disclosure will become readily apparent based on the teachings contained herein.

BRIEF DESCRIPTION OF THE DRAWINGS

The foregoing and other aspects will now be described by way of example only with reference to the attached drawings, in which.

DETAILED DESCRIPTION

Figure 1A:
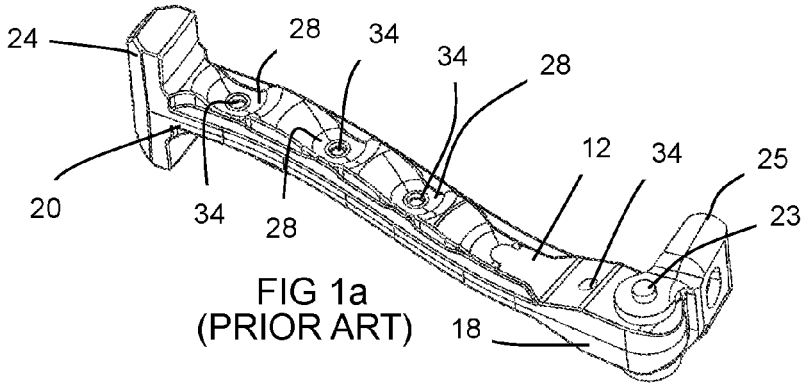
FIG 1a (PRIOR ART)
FIG. 1*a* is a perspective view of a check arm for use as part of a check arm assembly for a vehicle door, in accordance with the prior art.
Figure 1B:
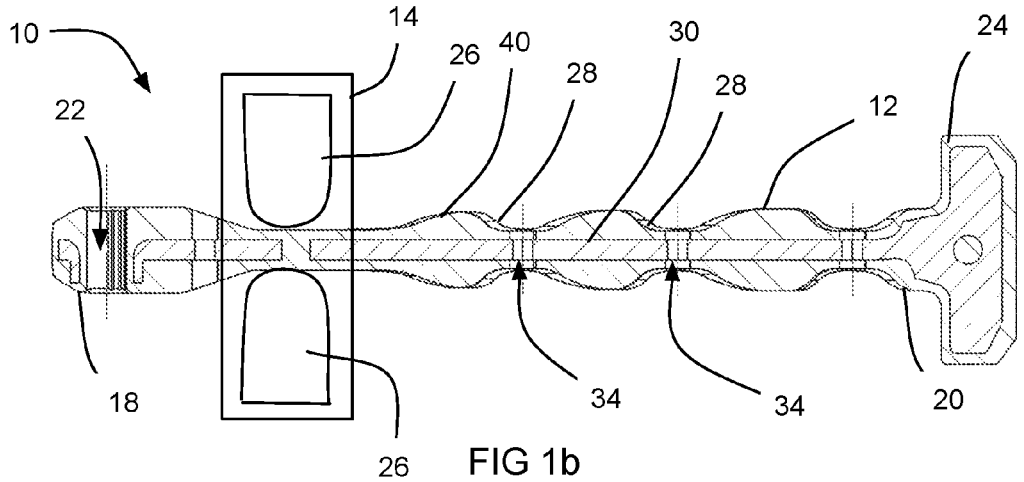
FIG 1b (PRIOR ART)
FIG. 1*b* is a sectional side view of the check arm shown in FIG. 1*a;*
Figure 1C:
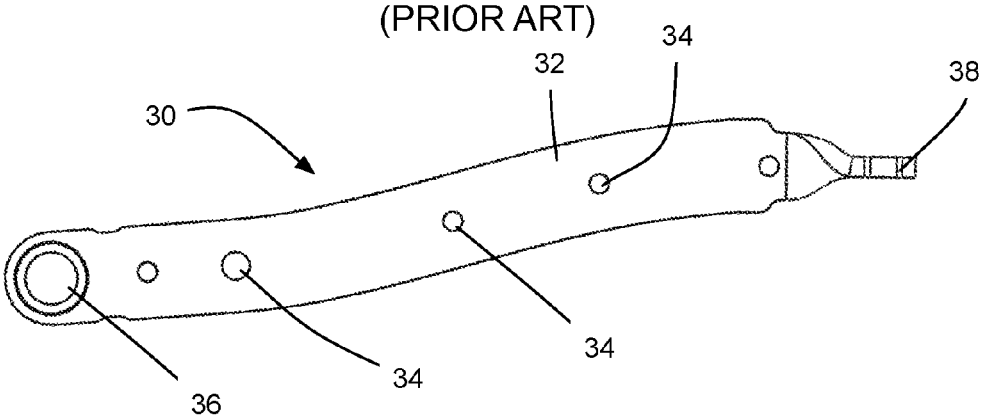
FIG 1c (PRIOR ART)
FIG. 1*c* is a plan view of a core that is part of the check arm shown in FIG. 1*b;*

Reference is made to FIGS. 1*a*-1*c*, which shows a vehicle door check 10 in accordance with the prior art. Referring to FIG. 1*b*, the door check 10 includes a check arm 12 and a check arm keeper 14. The check arm 12 includes a body 16 that has a first end 18 and a second end 20. A pivot aperture 22 is provided at the first end 18, and an end stop 24 is provided at the second end 20. The pivot aperture 22 receives a pin 23 (FIG. 1*a*) from a mounting bracket 25 on the body of the vehicle (not shown), so that the check arm 12 is pivotally connected to the vehicle body.

The check arm keeper 14 is mounted to the door (not shown) and has stop bodies 26 that may be spring driven to engage detents 28 to stop the door in selected positions relative to the vehicle body. The keeper 14 is shown as an outline with the stop bodies 26 therein, for simplicity.

The check arm 12 is typically made by a relatively complex process and is resultingly relatively expensive. First, a core member shown at 30 in FIG. 1*c*, is formed from a metallic blank. The core member 30 has a body 32, which has a plurality of holding apertures 34 punched therethrough, which will be explained further below. Additionally, a core pivot aperture 36 is formed (e.g. by punching) at a first end of the core member 30. Furthermore, at a second end of the core member 30, an end portion 38 is twisted so as to form a core for the end stop 24.

After all of the above steps are performed on the core member 30, a covering layer 40 is overmolded onto the core member 30. To achieve this, the core member 30 is placed in a mold cavity (not shown) and is held in position in the mold cavity by projections (not shown) that extend from the wall of the mold cavity into the holding apertures 34. Once the overmolding step is complete the check arm 12 may be ready for use.

Because the apertures 34 are still exposed after the overmolding step, there is the potential for corrosion of the core member 30 over the life of the vehicle. Thus, to prevent such corrosion the core member 30 is typically plated prior to the overmolding step.

All of the above steps add to the cost of manufacturing the check arm 12.

Figure 2:
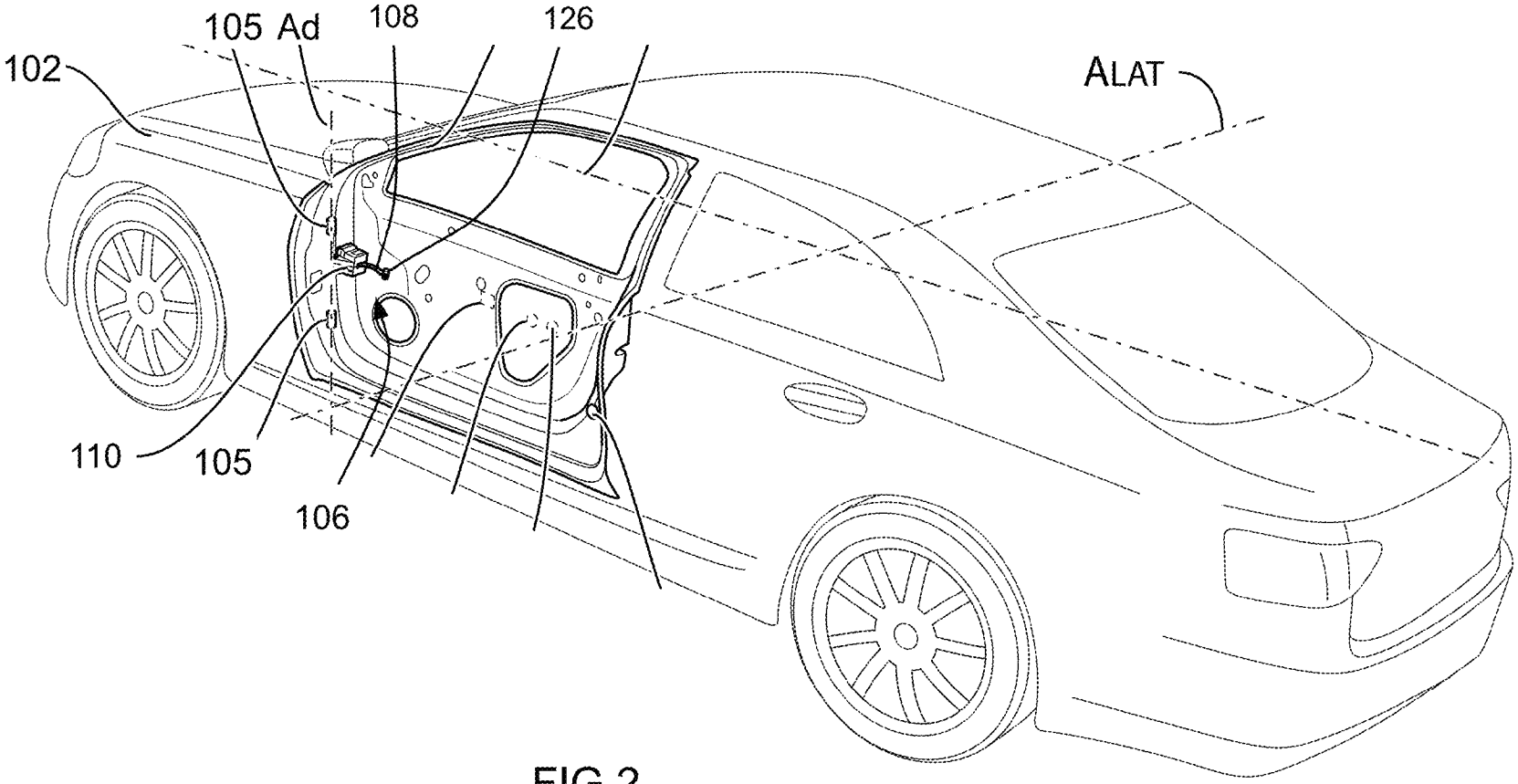
FIG. 2 is a perspective view of a vehicle that has a check arm assembly with a check arm in accordance with an embodiment of the present invention.

Reference is made to FIG. 2, which shows a vehicle 100 that includes a vehicle body 102, a vehicle door 104 (that, in the embodiment shown, is pivotally connected to the vehicle body 102 via hinges 105 for pivotal movement about a door axis Ad), and a door check 106 that includes a check arm 108 and a check arm keeper 110, in accordance with an embodiment of the present invention. The vehicle 100 shown in FIG. 2 is an automobile, but it may alternatively be any other suitable type of vehicle.

The vehicle body 102 refers to any component of the vehicle 100 that is non-moving. This includes, the chassis and the body panels for example. The vehicle door 104 is shown as a driver's-side, front door, however it may be any suitable vehicle door.

Figure 3:
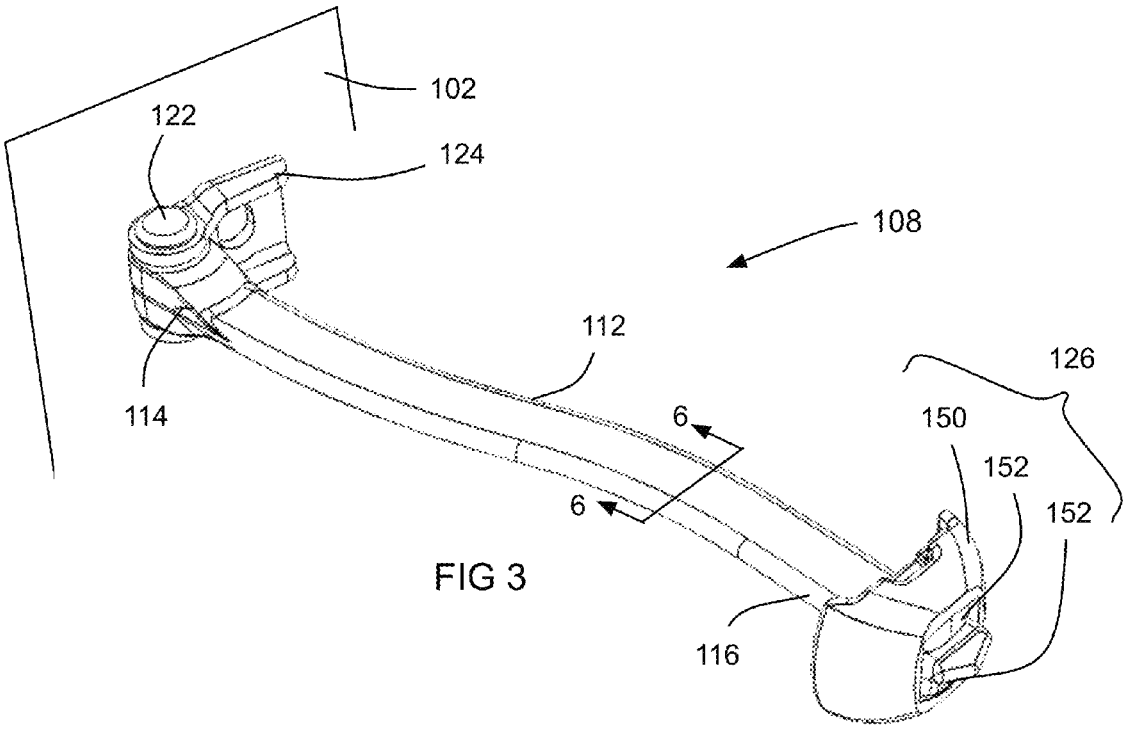
FIG. 3 is a perspective view of a check arm shown in FIG. 2.
Figure 4:
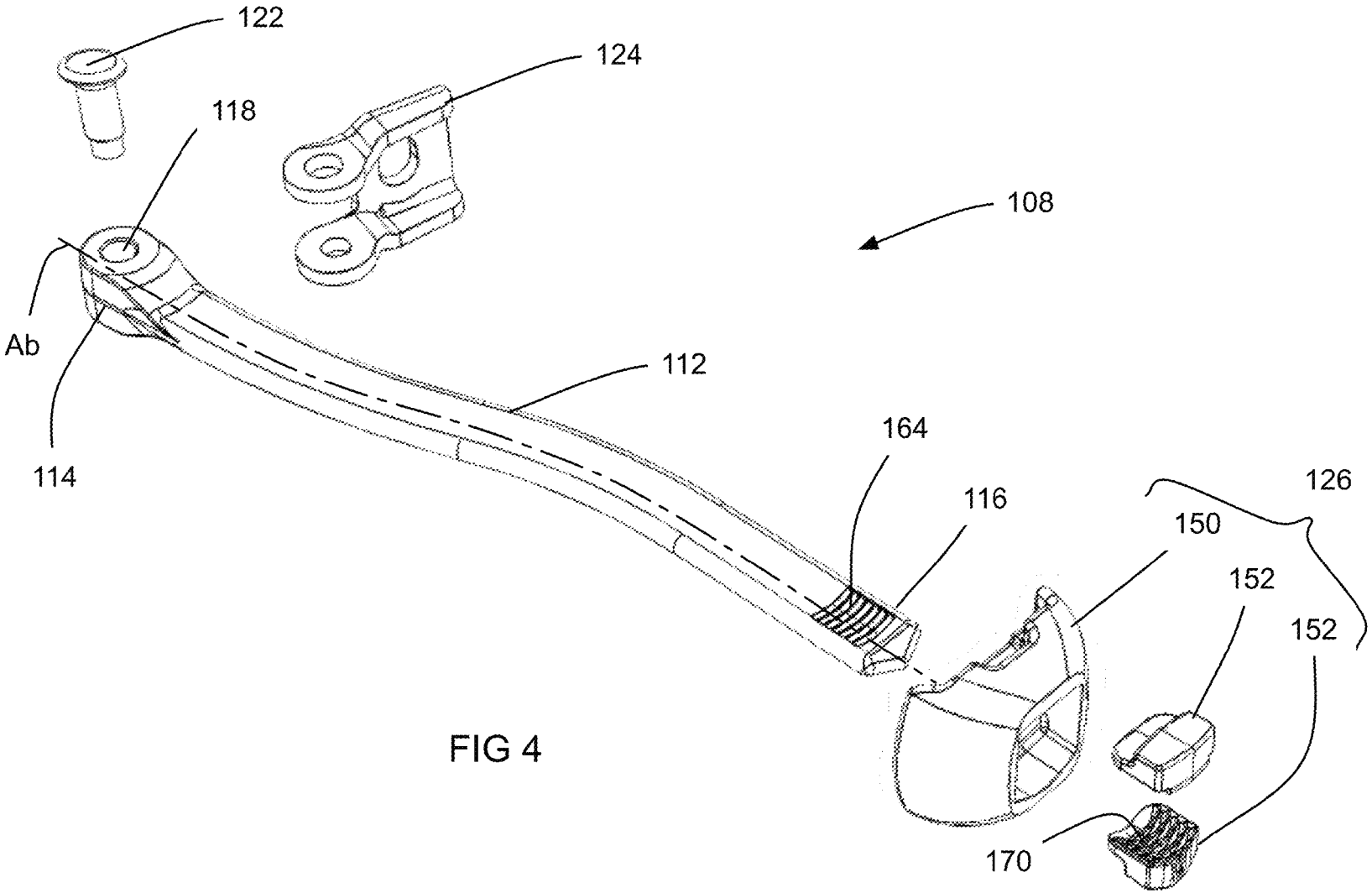
FIG. 4 is a perspective exploded view of the check arm shown in FIG. 3.

Referring to FIGS. 3 and 4, the check arm 108 has a body 112 defining a longitudinal axis Ab (FIG. 4) and having a first body end 114 and a second body end 116. A pivot connector 118 is positioned at the first body end 114 and is configured for pivotally connecting the check arm 108 to one of the vehicle body 102 and the vehicle door 104. In the embodiment shown, the pivot connector 118 is a pivot aperture that passes through the body 112 and is positioned to receive a pin 122 that is on the aforementioned one the vehicle body 102 and the vehicle door 104.

In the example shown in FIGS. 3 and 4 the pivot connector 118 pivotally connects the check arm 108 to the vehicle body 102 and the check arm keeper 110 is mounted to the vehicle door 104. More specifically, in the example shown, the pivot connector 118 receives the pin 122 from a mounting bracket 124 that is fixedly connected to the vehicle body 102 (FIG. 3).

An end stop 126 is positioned at the second body end 116, and is positioned to limit the amount of withdrawal of the check arm 108 from the check arm keeper 110 (FIG. 2) that is on the other of the vehicle body 102 and the vehicle door 104.

Figure 5:
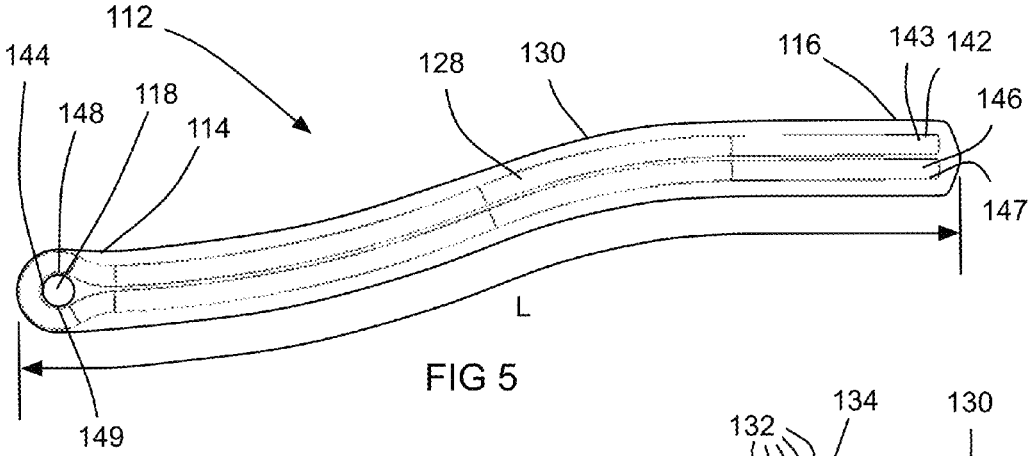
FIG. 5 is a plan view of a body of the check arm shown in FIG. 3 with a portion of the body cut away.

As shown in FIG. 5, the check arm body 112 is a composite structure that includes a structural element 128, that is itself made up of a plurality of fibers 132 (FIG. 6) and a binder 134, and may include an outer layer 130. As such, in some embodiments, such as that which is shown in FIGS. 2-7, the structural element 128 may also be referred to as the core 128.

Figure 6:
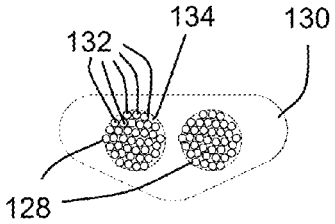
FIG. 6 is a sectional view along section line 6-6 in FIG. 3.

FIG. 5 is a view of the body 112 with some of the outer layer 130 cut away, to reveal the core 128 therein. Referring to FIG. 6, the core 128 may itself be made up of a plurality of elongate structural fibers 132 and a binder 134 that connects the structural fibers together. Each structural fiber 132 extends longitudinally along substantially the entire length of the body 112, (wherein the length is shown at L in FIG. 5). As a result, the tensile strength of the body 112 may be very high. Depending on the material selected for the structural fibers 132, the tensile strength of the body 112 may exceed that of steel. In some embodiments, the structural fibers 132 may be made from glass, or alternatively, from carbon, Kevlar™, natural fibers, or from some other suitable material. The binder 130 that is used to hold the fibers 128 together may be made from any suitable material, such as, for example, Nylon 6. Other materials may alternatively be used for the binder 130.

Figure 10:
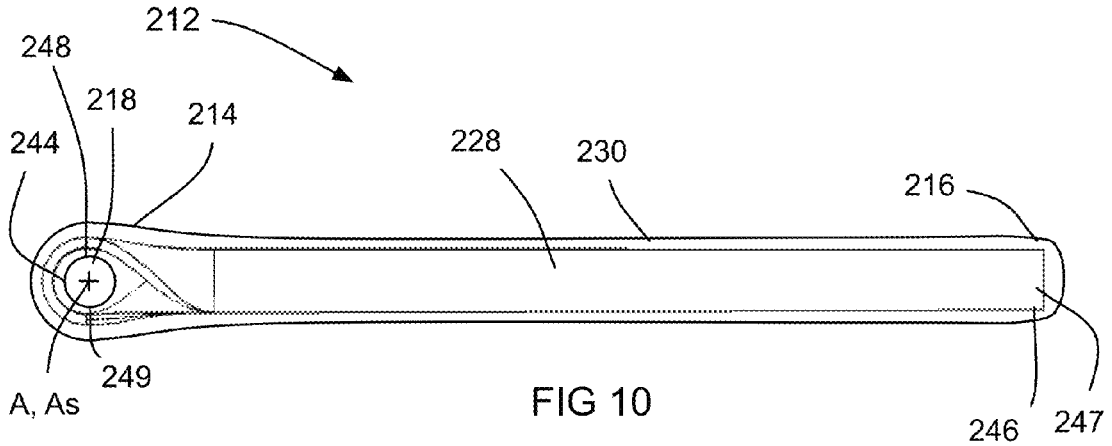
FIG. 10 is a plan view of a body of the check arm shown in FIG. 8 with a portion of the body cut away.
Figure 11:
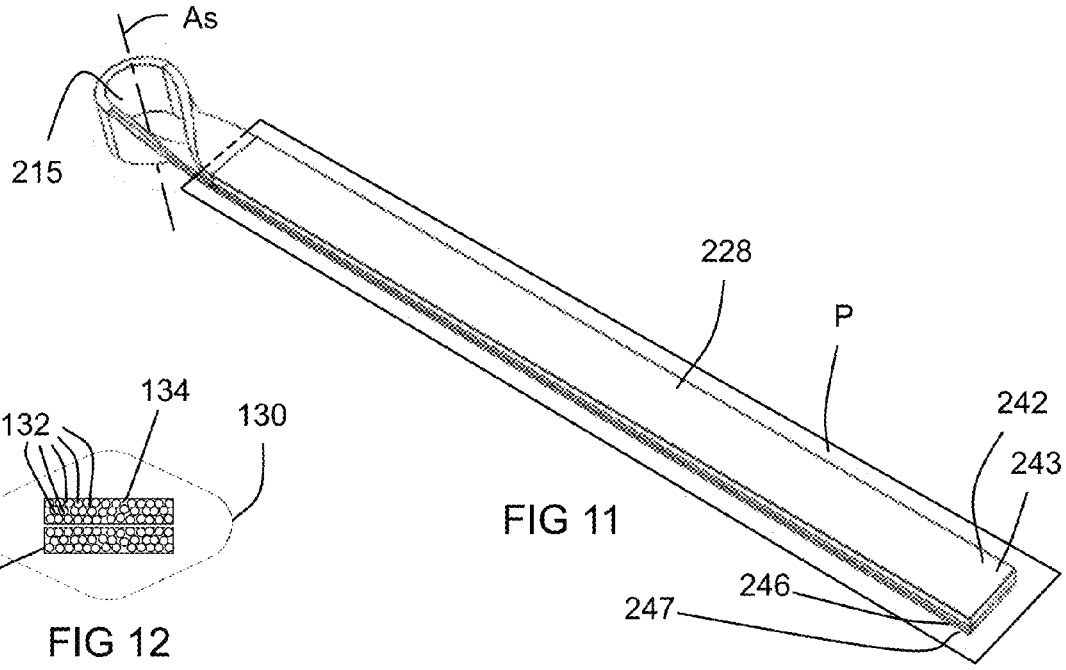
FIG. 11 is a perspective view of a core of the body shown in FIG. 10.

An example for the material that could be used for the core is Ticona Celstran CFR-TP PA66 GF60-01, provided by Celanese Corporation in Irving, Tex., USA. This is a material that has 60% by weight long glass fiber In the embodiment shown, the core 128 is in the form of a cable having a generally circular cross-sectional shape. This permits the core 128 to extend along a curved path (see FIG. 5), more easily than a core 128 that is in certain other forms, such as in the form of a strip (an example of which is shown in FIGS. 10 and 11).

In the embodiment shown, each of the structural fibers 132 extends from a first structural fiber end 142 positioned proximate the second body end 116 (and therefore proximate the end stop 126), along the length of the body 112 to the pivot connector 118, around a distal end 144 of the pivot connector, and along the length of the body 112 to a second structural fiber end 146 that is positioned proximate the second body end 116 (and therefore proximate the end stop 126).

The same may be said for the structural element or core 128. The structural element 128 extends from a first core end 143 positioned proximate the second body end 116 (and therefore proximate the end stop 126), along the length of the body 112 to the pivot connector 118, around a distal end 144 of the pivot connector, and along the length of the body 112 to a second structural fiber end 147 that is positioned proximate the second body end 116 (and therefore proximate the end stop 126).

Put another way, each structural fiber 132 has first and second structural fiber ends 142 and 146, both of which are positioned proximate the second body end 116. Each structural fiber 132 surrounds the pivot connector 118 longitudinally on a distal end 144 of the pivot connector 118 and laterally on first and second sides shown at 148 and 149 of the pivot connector 118.

Similarly, the structural element or core 128 has first and second core ends 143 and 147, both of which are positioned proximate the second body end 116. The structural element or core 128 surrounds the pivot connector 118 longitudinally on a distal end 144 of the pivot connector 118 and laterally on first and second sides shown at 148 and 149 of the pivot connector 118.

To manufacture the body 112, the core 128 may be heated sufficiently to be malleable and then arranged in the desired shape, and then cooled. Once cooled, the core 128 may be have a fixed shape and is self-supporting in the shape shown in FIG. 5. Once formed, the core 128 is positioned in a mold in the appropriate configuration and is overmolded with the outer layer 130, which may be any suitable material, but which is preferably made from the same material as the binder 134 so that the binder 134 and the outer layer 130 join together in a stronger manner. Other materials could be used, however, to overmold the outer layer 130, such as, for example, other polymers. Once overmolded, the outer layer 130 may substantially entirely cover the core 128, except for small areas where the core 128 was held by elements in the mold cavity. Because the core 128 is non-metallic (i.e. because the fibers 132 and the binder 134 are non-metallic), even though some of the core 128 may be exposed to atmosphere, it would not be problematic since there is no corrosion risk for the core 128.

It will be noted that providing a core in the form of fibers that are each substantially the entire length of the body 112 renders the body 112 relatively strong while benefiting from reduced weight as compared to a body that incorporates a metallic plate, as shown in FIGS. 1*a*-1*c*.

By routing the core 128 from the second body end 116, around the pivot connector 18 and then back to the second body end 116, as shown and described, provides the pivot connector 118 with the tensile resistance that is provided throughout the length of the body 112.

The end stop 126 may have any suitable configuration. For example, the end stop 126 may be formed from a blocking member 150, and first and second wedge members 152. The blocking member 150 is positioned to engage a limit surface associated with one of the door 104 or the body 102 when the door 104 has been opened by a selected amount, so as to limit the amount of withdrawal of the check arm 108 from the check arm keeper 110 (FIG. 2). In the embodiment shown, the pivot connector 118 is connected to the body 102 and so the blocking member 150 is engageable with a limit surface on the check arm keeper 110, which is associated with the door 104.

Figure 7:
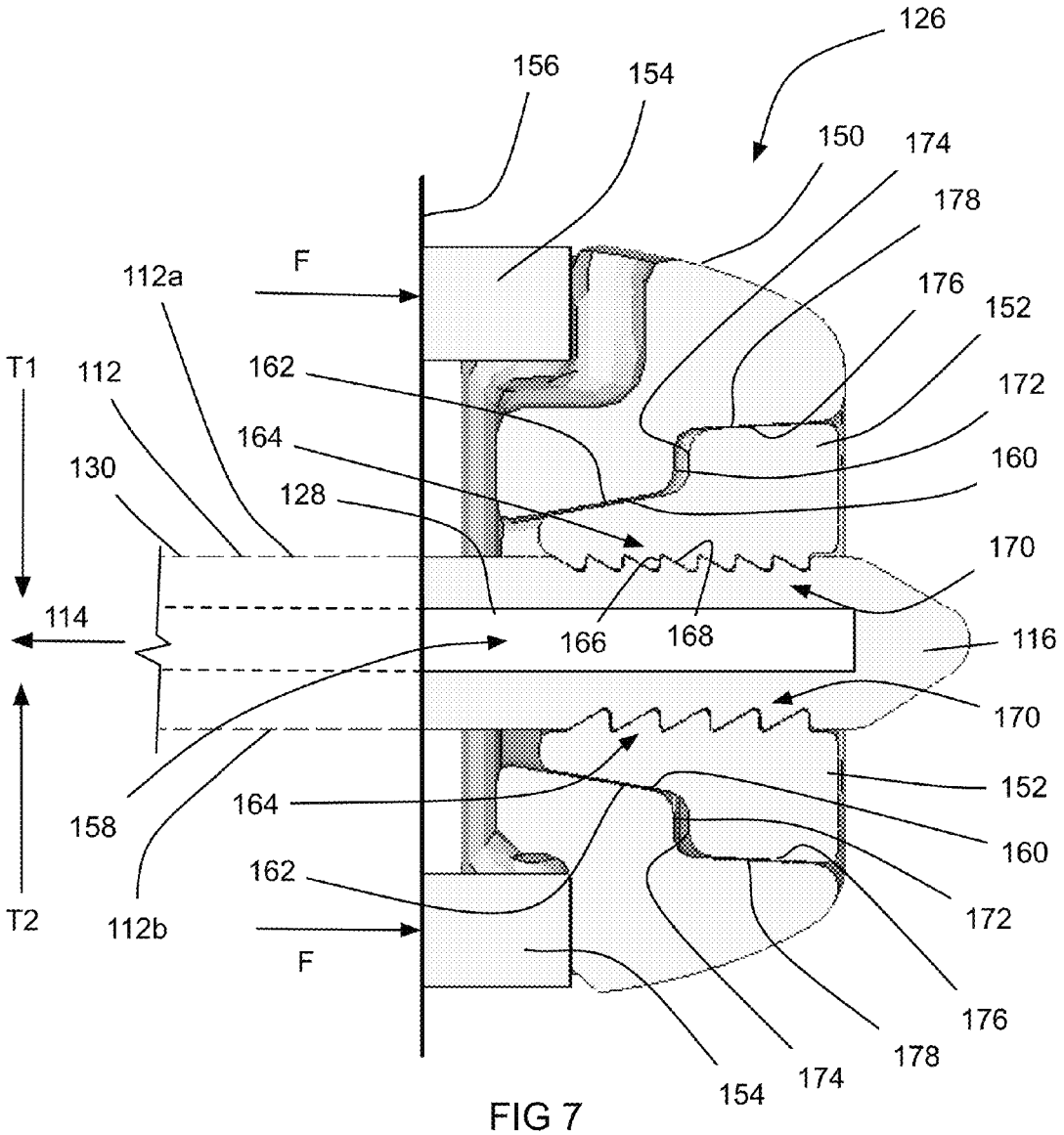
FIG. 7 is a sectional side view of a portion of the check arm shown in FIG. 3.
Figure 8:
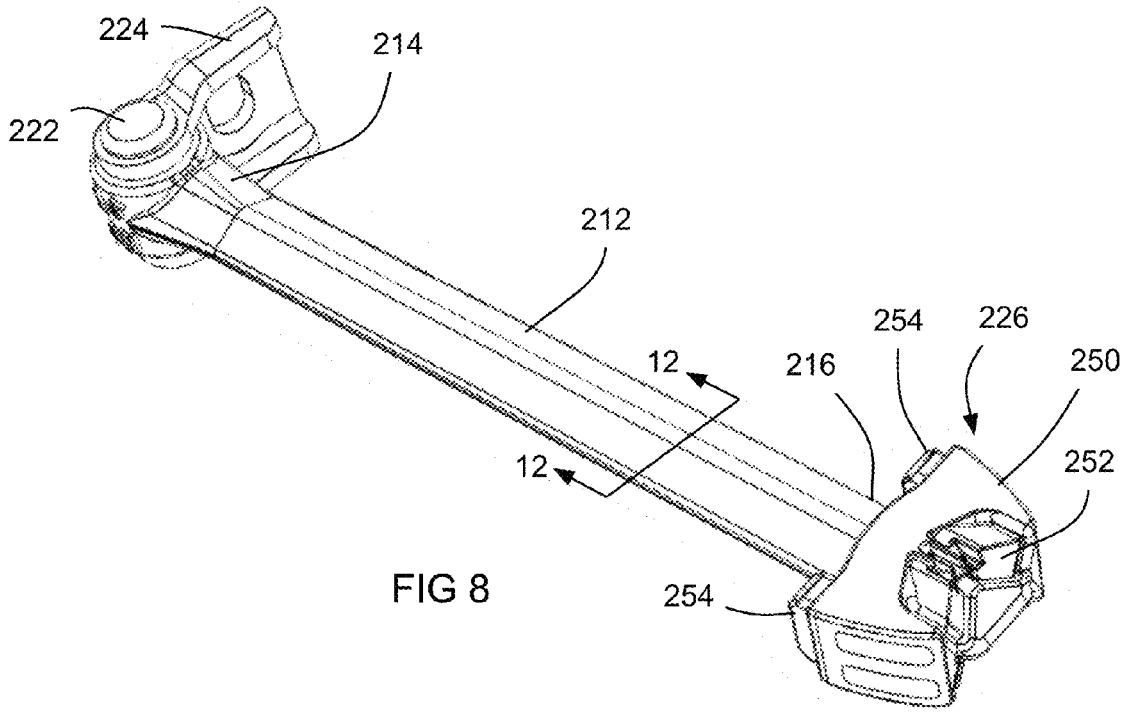
FIG. 8 is a perspective view of a check arm in accordance with another embodiment of the present invention.

Referring to FIG. 7, the blocking member 150 may have any suitable construction. For example the blocking member 150 may be made from a polymeric material such as a type of Nylon and may have one or more bumpers 154 thereon to cushion the engagement of the blocking member 150 with the limit surface, shown at 156, thereby reducing impact shock and noise during engagement. The bumpers 154 are shown in FIG. 7, but are omitted from FIGS. 3 and 4 for convenience.

The blocking member 150 has an inner surface defining a pass-through aperture 158. On the inner surface are two first wedge surfaces 160 that face generally towards the second body end 116 and that are generally opposed to one another. Each of the wedge members 152 has an outer surface with a second wedge surface 162 thereon that faces generally towards the first body end 114. The operation of the wedge members 152 is described further below.

The body 112 has a first side 112*a* and a second side 112*b*, each of which has a plurality of first teeth 164 formed thereon. Each first tooth 164 has a first tooth face 166 facing the first body end 114 (represented by an arrow in FIG. 7) and a second tooth face 168 facing the second body end 116. The first teeth 164 are skewed towards the first body end 114. In other words, the teeth 164 are not symmetrical; instead the first tooth face 166 extends at a steeper angle than the second tooth face 168 on each tooth 164. Each of the wedge members 152 further has a plurality of second teeth 170 that are on a surface that is generally opposed to the second wedge surface 162. Each of the second teeth 170 are skewed towards the second body end 116 and may be configured to fit generally matingly with the first teeth 164.

The second wedge surface 162 on each of the wedge members 152 is engageable with one of the first wedge surfaces 160, and is oriented such that a longitudinal force exerted on the blocking member 150 towards the second body end 116 urges the first wedge surface 160 into the second wedge surface 162, which in turn urges the second teeth 170 transversely inwardly (shown by arrows T1 and T2) and longitudinally towards the first teeth 164. Such a longitudinal force would occur during engagement of the blocking member 150 with the limit surface 156, and is represented by arrows F in FIG. 7.

The engagement of the first and second teeth 164 and 170 holds the end stop 126 onto the second body end 116 and prevents the end stop 126 from being driven off the second body end 116. Because the first teeth 164 are skewed towards the first body end 114 and the second teeth 170 are skewed towards the second body end 116, the teeth 164 and 170 cooperate to resist sliding on one another during exertion of the longitudinal force on the blocking member 150 towards the second body end 116.

By providing two wedge members 152 and a plurality of first teeth 164 on each of the sides 112*a* and 112*b* of the body 112, which are engaged by the second teeth 170 on the wedge members 152, the force of the wedge member 152 on the first side 112*a* of the body 112 and the force of the first wedge surface 160 of the blocking member 150 on that wedge member 152 cooperates with the force of the wedge member 152 on the second side 112*a* of the body 112 and the force of the other first wedge surface 160 of the blocking member 150 on that wedge member 152 so that there is generally symmetry in the forces acting on the blocking member 150 and the body 112.

As the longitudinal force F on the blocking member 150 increases, the more the wedge surfaces 160 ride up the second wedge surfaces 162, which causes an increase in the force with which the first and second teeth 164 and 170 engage one another. This permits stresses on the blocking member 150 and the body 112 to be low when longitudinal forces on the blocking member 150 are low and to be high when longitudinal forces on the blocking member 150 are high. The blocking member 150 has a pair of first stress limit surfaces 172 that are engageable with second stress limit surfaces 174 on the wedge members 152. These stress limit surfaces 172 and 174 engage each other when the longitudinal forces F exceed a selected limit. Once these surfaces 172 and 174 engage each other, the wedge surfaces 160 are prevented from riding any further up the wedge surfaces 162, thereby limiting the stresses imposed on the blocking member that drive the two wedge surfaces 160 apart from one another.

In this way the blocking member 150 is prevented from being stretched apart in the transverse direction to the point of failure.

It will be noted that the wedging force that urges the wedge members 152 into engagement with the teeth 160 on the body 112, also urges the blocking member 150 towards the first body end 114. To resist this force, the blocking member 150 has two first gripping surfaces 176 that engage a second gripping surface 178 on each of the second wedge members 152. The first and second gripping surfaces may be angled, in similar manner to the wedge surfaces 160 and 162. The angle of inclination of the first and second gripping surfaces 178 may be smaller than that of the wedge surfaces 160 and 162, to promote sliding of the surfaces 176 and 178 during engagement and disengagement of the blocking member 150 from the wedge members 152. The angle of inclination of the first and second gripping surfaces 176 and 178 may be non-zero (i.e. greater than zero), thereby generating some wedging action to, in turn, generate a normal force between the two surfaces 176 and 178. This, in turn, results in a friction force between the two surfaces 176 and 178. By having an angle of inclination that is sufficiently small (i.e. close to zero) there will be sufficient friction between the surfaces 176 and 178 to resist the urging of the blocking member 150 off the wedging surfaces 162. Optionally resilient clips (not shown) in either the blocking member 150 or the wedge members 152 could be provided that engage detents in the other of the blocking member 150 or the wedge members 152 to more positively lock the blocking member 150 and wedge members 152 together. It will be noted that the forces transferred through the end stop 126 into the cover layer 130 of the body 112 are transferred into the core member 128, since the core member 128 extends through the portion of the body 112 with the teeth 164.

In the example shown there are two first wedge surfaces 160 (both on the blocking member 150) and two second wedge surfaces 162 (one on each of the wedge members 152). It is alternatively possible to provide only one first wedge surface 160 on the blocking member 150 and only one wedge member 152 with one second wedge surface 162, and, for example, to configure the blocking member 150 to slide snugly against the opposing side 112*a* or 112*b* of the body 112 so as to oppose any vertical component of any wedging forces.

By forming the end stop 126 by incorporating a blocking member 150 with one or more wedge members 152 that engage teeth in the body 112, the strength of the core 128 can be used to assist in resisting a longitudinal force against the end stop 126, even though the core is an elongate cable. This replaces the metallic plate that formed the core 30 in the embodiment in FIGS. 1*a*-1*c*, which had an enlarged head at one end which was twisted to be transverse to the plane of the plate so as to extend in a suitable direction to provide strength to the end stop 24.

With reference to FIG. 6, it will be noted that the check arm body 112 has a peaked cross-sectional profile on one side (side 112*b*). As compared to a check arm with a flat cross-sectional profile on both sides, the peaked profile on the side 112*b* increases the overall amount of surface area on the check arm body 112 that is available for interaction with other components, such as the teeth 170 (FIG. 4) on the wedge members 152 and the stop bodies on the check arm keeper (not shown). By providing an increased surface area for contact with the teeth 170, the peak stresses incurred when a given tensile load is applied to the check arm 108 are relatively lower than they would be with a check arm body that has a flat profile on both sides.

Reference is made to FIGS. 8-12, which shows a check arm 208. In general, the elements of the check arm 208 are given reference numbers start with a leading '2' but which end with the same two digits as the analogous elements of the check arm 108. These elements are similar to the analogous elements of the check arm 108 except where noted below. The check arm 208 is similar to the check arm 108 and is configured for being operated with a variant of the check arm keeper 110. The check arm 208 includes a body 212, which has a first end 214 and a second end 216, and which is made up of a structural element 228 (which may be made up of a plurality of fibers 232 and a binder 234), and optionally a cover layer 230, in which case, the structural element 228 may be referred to as a core 228. The check arm 208 further includes a pivot connector 218 at the first body end 214 and an end stop 226.

A difference between the check arm 208 and the check arm 108 is that the core member 228 is formed from a strip of material instead of being a cable as is the core member 128. In some instances, the core 228 may be referred to as the strip 228. As noted above, the core 228 is made from a plurality of long strand structural fibers 232 and a binder 234, which may be made from the same materials as the fibers 132 and binder 134 respectively.

In the embodiment shown, each of the structural fibers 232 extends from a first structural fiber end 242 positioned proximate the second body end 216 (and therefore proximate the end stop 226), along the length of the body 212 to the pivot connector 218, around a distal end 244 of the pivot connector 218, and along the length of the body 212 to a second structural fiber end 246 that is positioned proximate the second body end 216 (and therefore proximate the end stop 226). However, it can be seen, particularly in the view shown in FIG. 12, that the body 212 is generally wider than it is tall. While the two ends 143 and 147 of the core 128 fit relatively easily laterally adjacent each other in the core 128, as can be seen in FIG. 6, the two ends shown at 243 and 247 of the strip 228 are positioned transversely adjacent one another so as to fit within the cross-sectional area of the body 212. The use of the strip 228 and its arrangement wherein the ends 243 and 247 are transversely adjacent one another permits the strip 228 to have a relatively larger cross-sectional area than the cable 128 while still fitting within a similar cross-sectional area. As a result, a check arm that incorporates the strip 228 may have lower stresses at a given tensile load then a similarly sized check arm that incorporates the cable 128.

As can be seen, the plane of the strip 228 in the region of the second body end 216 is shown at P and extends generally longitudinally and laterally. However, the axis of the pivot aperture 218 at the first body end 214 is shown at A and extends generally perpendicularly to the plane P. In order for the strip 228 (and the structural fibers 232) to extend from the first strip end 243 (and the first fiber end 242) that is proximate the second body end 216 (and therefore proximate the end stop 226), along the length of the body 212 to the pivot connector 218, around a distal end 244 of the pivot connector, and along the length of the body 212 to the second strip end 247 (and the second fiber end 246) that is proximate the second body end 216 (and therefore proximate the end stop 226), the strip 228 is twisted by 90 degrees proximate the first body end 214 so as to form an end loop 251 having an axis As that is parallel to the axis A of the pivot aperture 218.

Put another way, and in similar fashion to the structural fibers 132, each structural fiber 232 has first and second structural fiber ends 242 and 246, both of which are positioned proximate the second body end 216, and each structural fiber 232 surrounds the pivot connector 218 longitudinally on a distal end 244 of the pivot connector 218 and laterally on first and second sides shown at 248 and 249 of the pivot connector 218.

Similarly, the core 228 has first and second core ends 143 and 147, both of which are positioned proximate the second body end 116. The core 228 extends from its first and second core ends 243 and 247 proximate the second body end 216 and surrounds the pivot connector 218 longitudinally on a distal end 244 of the pivot connector 218 and laterally on the first and second sides 248 and 249 of the pivot connector 218.

To manufacture the body 212, the strip that forms the core 228 may be formed by connecting a plurality of plies of sheet material containing the fibers 232 and binder 234 (e.g. by heat). Once the strip is formed, sufficient heat applied to the strip keeps it malleable, permitting it to be twisted to form the aperture 215. After being arranged as desired, the two lengths of the strip that are transversely adjacent one another can be bonded together via heat. After this step, the strip may be cooled at which point it hardens and is self-supporting. To form the cover layer 230 on the core 228, the core 228 is positioned in a mold in the appropriate configuration, in similar fashion to the core 128 described above.

Figure 9:
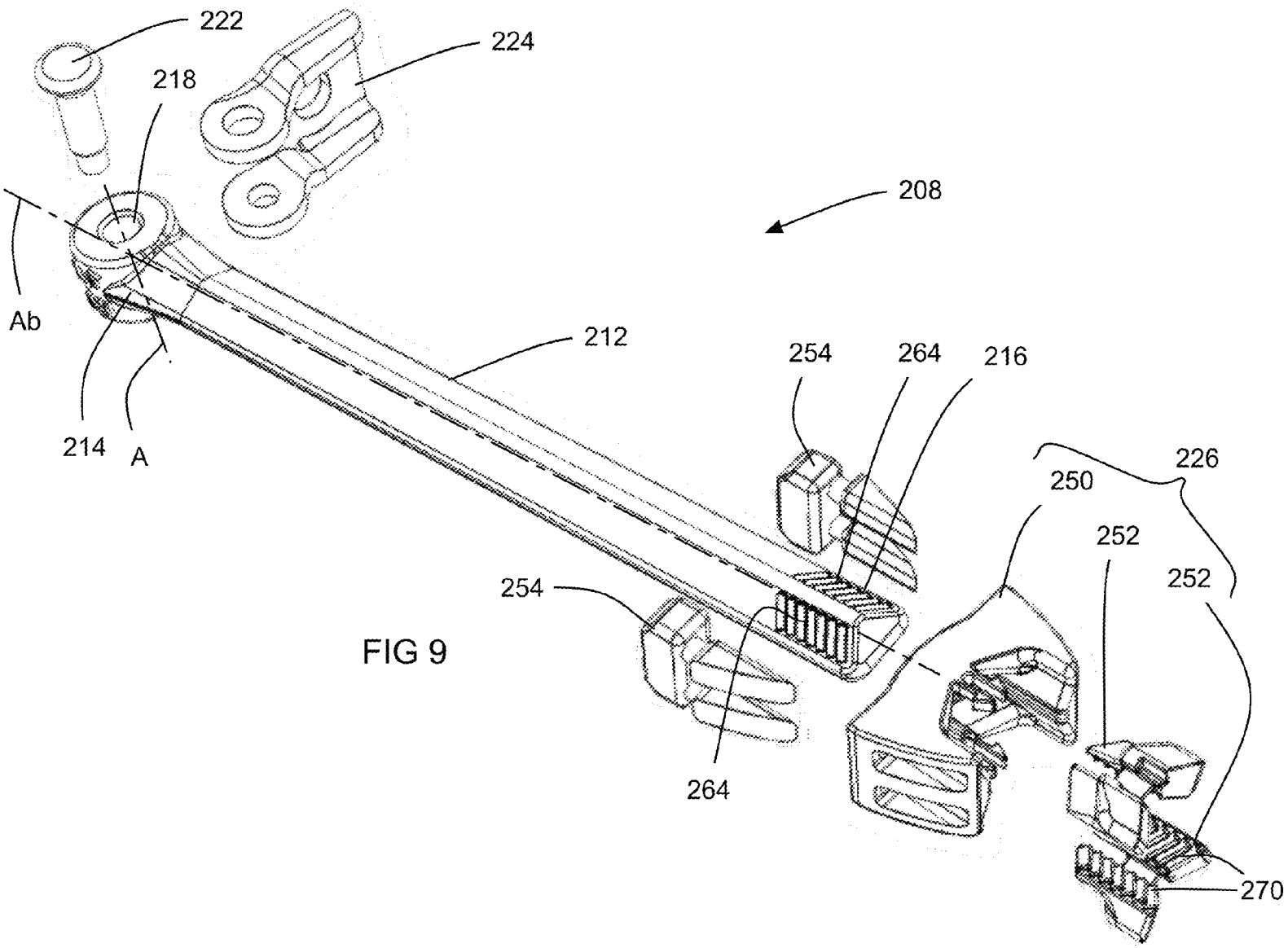
FIG. 9 is a perspective exploded view of the check arm shown in FIG. 8.
Figure 12:
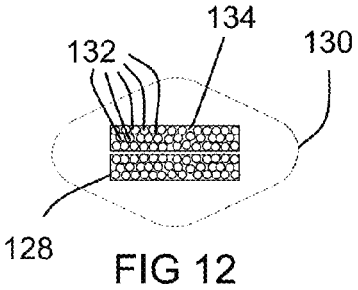
FIG. 12 a sectional view along section line 12-12 in FIG. 8.

The end stop 226 may be similar to the end stop 126, and includes a blocking member 250 that holds bumpers 254 and that engages wedge members 252 to urge second teeth 270 on the wedge members into engagement with first teeth 264 on the body 212. A difference here is that the body 212 has a generally diamond-shaped cross-sectional shape, having a peaked cross-sectional profile on both sides 212*a* and 212*b* (FIG. 12). As compared to a check arm with a flat cross-sectional profile on one or both sides, the peaked profile increases the amount of surface area on each side 212*a* and 212*b* that is available for interaction with other components, such as the teeth 270 on the wedge members 252 and the stop bodies on the check arm keeper. By providing an increased surface area for contact with the teeth 270, the peak stresses incurred when a given tensile load is applied to the check arm 208 are relatively lower than they would be with a check arm body that has a flat profile on one or both sides. As can be seen in FIG. 9, in addition to providing the peaked profile on both sides of the check arm body 212, the first teeth 264 on the check arm body 212 and the second teeth 270 on the wedge members 252 may be angled so as to have an angle relative to the longitudinal axis Ab that is less than 90 degrees and is greater than 0 degrees. This also increases the surface area of contact between the teeth 264 and the teeth 270, which also reduces the stresses that are incurred by the body 212 as compared to a body with teeth that extended directly laterally. In an example, the teeth 264 and 270 may be angled approximately 60 degrees from the longitudinal axis Ab.

At the first end 214 of the body, the pivot connector 218 may be similar to the pivot connector 118, and may be engaged by a pin 222 that is similar to pin 122 and that pivotally connects the body 212 to a mounting bracket 224 that may be similar to the mounting bracket 124.

Figure 13:
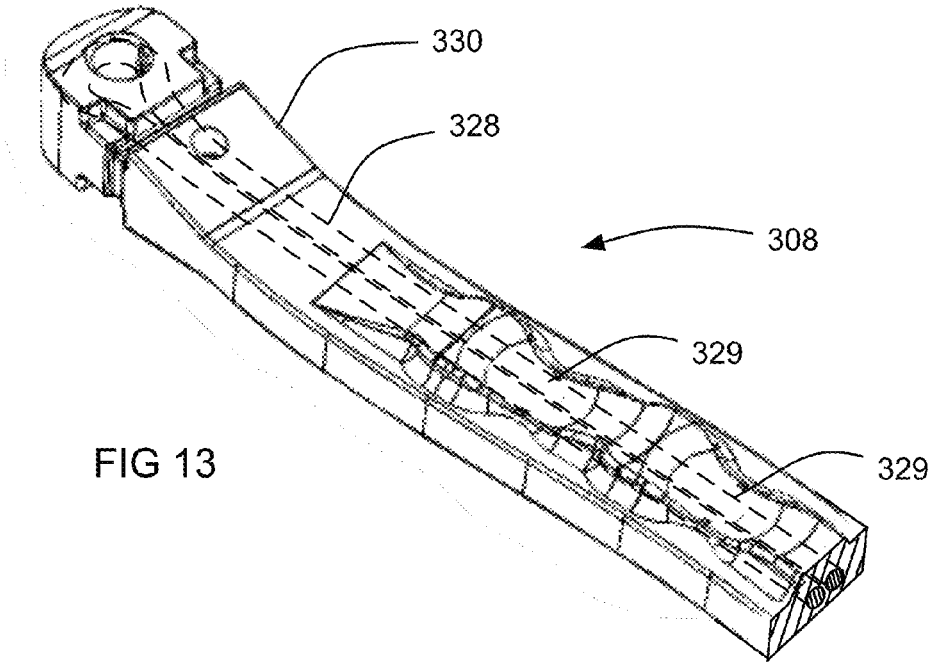
FIG. 13 is a perspective view of a portion of a check arm in accordance with another embodiment of the present invention.

In the embodiments shown in FIGS. 2-12, the check arm body 112, 212 is smooth in the longitudinal direction and is configured to be engaged by a variant of the check arm keeper 14 (FIG. 1) that is configured to drive the stop members 26 into the check arm body 112, 212 (FIGS. 4, 9) with sufficient force that the check arm keeper 14 can hold the check arm 108, 208 stationary in any position along substantially all of the length of the check arm body 112, 212. Such a check arm keeper 14 may be configured to be controllable so as to actively control the force with which the stop members 26 are driven into the check arm 108, 208 (e.g. via electric motors, or hydraulic actuators). However, it will be understood that the use of fibers 132, 232 that extend along the length of the body 112, 212 may also be used with a check arm that has detents thereon, for cooperation with a check arm keeper that is entirely passive, with simple springs that urge the stop members 26 into engagement with the check arm. Such an embodiment is shown in FIG. 13, which shows a portion of a check arm 308 that is a variant of the check arm 108 and has a core 328 that may a cable made from a fibers similar to the fibers 132 and a binder similar to binder 134. The difference between the check arm 308 and the check arm 108 is that the overmolding (shown at 330) on the check arm 308 includes a plurality of detents 329, which can be engaged by the stop members 26 on check arm keeper 14. It will be noted that, while the detents are shown without any apertures, some means may be provided for ridding the detents 329 of any debris or liquid that may accumulate in them. For example, lateral grooves that extend out to the side edges of the 308 may be provided so as to drain the detents of debris or liquid. In an alternative embodiment the check arm 308 could be configured to have a core made from a strip, similar to the core 228 in the embodiment shown in FIGS. 8-12.

It will be noted that only a portion of the check arm 308 is shown, for simplicity and that the end stop for the check arm 308 is omitted. The end stop for this check arm 308, however, may be similar to either of the end stops 126 or 226.

While the check arms 108 and 208 are shown as having end stops 126 and 226, it will be noted that any other suitable end stop may be used instead.

While the above description constitutes specific examples, these examples are susceptible to further modification and change without departing from the fair meaning of the accompanying claims.

What is claimed:

1. A check arm for a vehicle door, comprising:

a body having a length and defining a longitudinal axis, and having a first body end and a second body end;

a pivot connector positioned at the first body end and is configured for pivotally connecting the check arm to one of a vehicle body and a vehicle door; and an end stop positioned at the second body end, and is positioned to limit the amount of withdrawal of the check arm from a check arm keeper on the other of the vehicle body and the vehicle door, wherein the body is non-metallic and includes a plurality of elongate structural fibers and a binder that connects the structural fibers together, wherein each structural fiber extends longitudinally along substantially the length of the body, wherein each structural fiber extends from a first structural fiber end positioned proximate the second body end, along the length of the body to the pivot connector, around a distal end of the pivot connector, and along the length of the body to a second structural fiber end that is positioned proximate the second body end, wherein the pivot connector is a pivot aperture that is positioned to receive a pin on said one of the vehicle body and the vehicle door, wherein the pivot aperture has a pivot aperture axis, and wherein the plurality of elongate structural fibers are in the form of a strip having a length, a width and a thickness, wherein the length is bigger than the width and the width is bigger than the thickness, wherein, along a first portion of the length of the body outside of the first body end the width and length of the strip define a surface that is perpendicular to the pivot aperture axis, and wherein, proximate the first body end, the strip is twisted at an angle of approximately 90 degrees such that the width and length of the strip define a surface that is substantially parallel to the pivot aperture axis.

2. A check arm as claimed in claim 1, wherein each structural fiber is a glass fiber.

3. A check arm as claimed in claim 1, wherein each structural fiber is non-metallic.

4. A check arm as claimed in claim 1, wherein each structural fiber surrounds the pivot connector longitudinally on a distal end of the pivot connector and laterally on first and second sides of the pivot connector.

5. A check arm as claimed in claim 1, wherein the structural fibers and the binder together form a core for the body and wherein the body further includes an outer layer that substantially entirely covers the core.

6. A check arm as claimed in claim 1, wherein the body has a plurality of first teeth thereon which are skewed towards the first body end, each first tooth having a first tooth face facing the first body end and a second tooth face facing the second body end, and wherein the end stop includes a blocking member and a wedge member, wherein the blocking member is positioned to engage a limit surface on at least one of the vehicle door, the vehicle body and the check arm keeper to limit the amount of withdrawal of the check arm from a check arm keeper, and has a first wedge surface that faces generally towards the second body end, and wherein the wedge member has a plurality of second teeth thereon that are skewed towards the second body end, and a second wedge surface that is engageable with the first wedge surface and is oriented such that a longitudinal force exerted on the blocking member towards the second body end urges the first wedge surface into the second wedge surface, which in turn urges the second teeth transversely inwardly towards the second tooth faces of the first teeth and longitudinally towards the first tooth faces of the first teeth.

7. A check arm as claimed in claim 6, wherein the body has a first side and a second side opposed to the first side, wherein one of the pluralities of first teeth is on each of the first and second sides of the body, and wherein the blocking member has two of the first wedge surfaces such that the two first wedge surfaces are opposed to each other, and wherein end stop includes two of the wedge members each having one said second wedge surface and one said plurality of second teeth, such that the longitudinal force exerted on the blocking member towards the second body end urges the first wedge surfaces into the second wedge surfaces, which in turn urges the two pluralities of second teeth transversely inwardly towards the second tooth faces of the two pluralities of first teeth and longitudinally towards the first tooth faces of the two pluralities of first teeth.

8. A check arm as claimed in claim 6, wherein the body has a side on which the first teeth are positioned, and wherein the side has a peaked cross-sectional profile.

9. A check arm as claimed in claim 6, wherein the first and second teeth extend at an angle that is less than 90 degrees relative to the longitudinal axis and is greater than 0 degrees.

10. A check arm for a vehicle door, comprising:

a body defining a longitudinal axis and having a first body end and a second body end;

a pivot connector positioned at the first body end and configured for pivotally connecting the check arm to one of a vehicle body and a vehicle door; and an end stop positioned at the second body end, and positioned to limit the amount of withdrawal of the check arm from a check arm keeper on the other of the vehicle body and the vehicle door, wherein the body has a plurality of first teeth thereon which are skewed towards the first body end, each first tooth having a first tooth face facing the first body end and a second tooth face facing the second body end, and wherein the end stop includes a blocking member and a wedge member, wherein the blocking member is positioned to engage a limit surface on at least one of the vehicle door, the vehicle body and the check arm keeper to limit the amount of withdrawal of the check arm from a check arm keeper, and has a first wedge surface that faces generally towards the second body end, and wherein the wedge member has a plurality of second teeth thereon that are skewed towards the second body end, wherein the wedge member further includes a second wedge surface that is engageable with the first wedge surface and is oriented such that a longitudinal force exerted on the blocking member towards the second body end urges the first wedge surface into the second wedge surface, which in turn urges the second teeth transversely inwardly towards the second tooth faces of the first teeth and longitudinally towards the first tooth faces of the first teeth.

11. A check arm as claimed in claim 10, wherein the body has a first side and a second side opposed to the first side, and wherein the body has two of the plurality of first teeth, wherein one of the pluralities of first teeth is on each of the first and second sides of the body, and wherein the blocking member has two of the first wedge surfaces such that the two first wedge surfaces are opposed to each other, and wherein the end stop includes two of the wedge members each having one said second wedge surface and one said plurality of second teeth, such that the longitudinal force exerted on the blocking member towards the second body end urges the first wedge surfaces into the second wedge surfaces, which in turn urges the two pluralities of second teeth transversely inwardly towards the second tooth faces of the two pluralities of first teeth and longitudinally towards the first tooth faces of the two pluralities of first teeth.

12. A check arm as claimed in claim 10, wherein the body has a side on which the first teeth are positioned, and wherein the side has a peaked cross-sectional profile.

13. A check arm as claimed in claim 10, wherein the first and second teeth extend at an angle that is less than 90 degrees relative to the longitudinal axis and is greater than 0 degrees.

14. A check arm for a vehicle door, comprising:

a body having a length defining a longitudinal axis and having a first body end and a second body end;

a pivot connector positioned at the first body end and is configured for pivotally connecting the check arm to one of a vehicle body and a vehicle door, wherein the pivot connector is a pivot aperture that is positioned to receive a pin on said one of the vehicle body and the vehicle door; and an end stop positioned at the second body end, and positioned to limit the amount of withdrawal of the check arm from a check arm keeper on the other of the vehicle body and the vehicle door, wherein the body is non-metallic and includes a plurality of elongate structural fibers and a binder that connects the structural fibers together, wherein the structural fibers and the binder together form a core that extends from a first core end positioned proximate the second body end, along the length of the body to the pivot connector, around a distal end of the pivot connector, and along the length of the body to a second core end that is positioned proximate the second body end, wherein the pivot connector is a pivot aperture that is positioned to receive a pin on said one of the vehicle body and the vehicle door, wherein the pivot aperture has a pivot aperture axis, and wherein the core is a strip having a length, a width and a thickness, wherein the length is bigger than the width and the width is bigger than the thickness, wherein, along a first portion of the length of the body outside of the first body end the width and length of the core define a surface that is perpendicular to the pivot aperture axis, and wherein, proximate the first body end, the strip is twisted at an angle of approximately 90 degrees such that the width and length of the core define a surface that is substantially parallel to the pivot aperture axis.

15. A check arm as claimed in claim 14, wherein the body further includes an outer layer that substantially entirely covers the core around the distal end of the pivot connector.

16. A check arm as claimed in claim 14, wherein the surface defined by the length and the width of the strip at the first core end is adjacent to the surface defined by the length and the width of the strip at the second core end.

17. A check arm as claimed in claim 1, wherein surface defined by the length and the width of the strip at the first core end is adjacent to the surface defined by the length and the width of the strip at the second core end.

* * * * *